US006441840B1

(12) United States Patent
Sato et al.

(10) Patent No.: US 6,441,840 B1
(45) Date of Patent: Aug. 27, 2002

(54) THICK-FILM THERMAL PRINTHEAD WITH IMPROVED PAPER TRANSFER PROPERTIES

(75) Inventors: Tadayoshi Sato; Takumi Yamade, both of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/881,808

(22) Filed: Jun. 18, 2001

(30) Foreign Application Priority Data

Jun. 19, 2000 (JP) ..... 2000-182909
Jun. 19, 2000 (JP) ..... 2000-182910

(51) Int. Cl.[7] ..... B41J 2/345; B41J 2/335
(52) U.S. Cl. ..... 347/208
(58) Field of Search ..... 347/208, 203, 347/202, 200; 29/611

(56) References Cited

U.S. PATENT DOCUMENTS 5,335,002 A 8/1994 Nagahata et al. ..... 346/76
5,485,192 A * 1/1996 Nagahata et al. ..... 347/203

FOREIGN PATENT DOCUMENTS

JP 4-25473 * 1/1992 ..... B41J/2/335

* cited by examiner

*Primary Examiner*—Huan Tran
(74) *Attorney, Agent, or Firm*—Michael D. Bednarek; Shaw Pittman LLP

(57) ABSTRACT

A thick-film thermal printhead includes an insulating substrate, an electrode pattern formed on the substrate and a linear heating resistor electrically connected to electrode pattern. The electrode pattern includes a common electrode and a plurality of individual electrodes. The common electrode includes a plurality of comb-teeth and a main conductor connected to the comb-teeth. The distance between the main conductor and the heating resistor is 0.25–0.75 times the width of the heating resistor.

13 Claims, 7 Drawing Sheets

THICK-FILM THERMAL PRINTHEAD WITH IMPROVED PAPER TRANSFER PROPERTIES

BACKGROUND OF THE INVENTION

1. Field of the Invention

The present invention relates to a thick-film thermal printhead which allows smooth transfer of a recording paper. The present invention also relates to a method of making such a thick-film thermal printhead.

2. Description of the Related Art

As is well known, thermal printheads are generally divided into the thick-film type and the thin-film type. A thick-film type thermal printhead includes a heating resistor which is larger in thickness than that of a thin-film thermal printhead. FIGS. 15 and 16 of the accompanying drawings illustrate an example of prior art thick-film thermal printhead. The illustrated printhead includes an insulating head substrate 11, a common electrode 12, a plurality of individual electrodes 13 and a linear heating resistor 14. The heating resistor 14 has a predetermined width and extends longitudinally of the head substrate 11. As shown in FIG. 15, the common electrode 12 includes a plurality of comb-teeth 12*a*, and a main conductor 12*b* to which the comb-teeth 12*a* are commonly connected. The teeth 12*a* and the individual electrodes 13 are alternately arranged. The heating resistor 14 extends across the teeth 12*a* and the individual electrodes 13. The distance between one edge 14*a* of the heating resistor 14 and the main conductor 12*b* is indicated by a reference sign S'.

As shown in FIG. 16, the main conductor 12*b* is provided with an auxiliary conductor 15. The auxiliary conductor 15, which is elongated in parallel with the heating resistor 14, prevents a voltage drop at the common electrode 12. As shown in this figure, there is provided a protective film 16 which covers the auxiliary conductor 15 as well as the common electrode 12, the individual electrodes 13 and the heating resistor 14. Due to the existence of the heating resistor 14 and the auxiliary conductor 15, the protective film 16 includes a first projection 16*a* and a second projection 16*b* projecting toward a platen roller R. In operation, the platen roller R presses a recording paper P against the first projection 16*a* for conducting required printing.

For smoothly moving the recording paper P along a paper transfer path, it is required that the paper P does not come into contact with the second projection 16*b* during the printing. Therefore, in the prior art printhead, by making the distance S' (between the heating resistor 14 and the main conductor 12*b*) larger (e.g. 200–300 $\mu$m) than the width of the heating resistor 14, the auxiliary conductor 15 is sufficiently spaced from the heating resistor 14 for making the second projection 16*b* spaced from the paper transfer path as much as possible.

Although the prior art printhead takes the above-described measures, it still has the following drawbacks.

A first drawback is as follows. In printing, heat is generated at the heating resistor 14. Part of the heat is transmitted directly to the head substrate 11 for dissipation, whereas other part of the heat is transmitted to the head substrate 11 via the common electrode 12 or the individual electrodes 13 for dissipation. However, when the distance S' is increased as described above, the length of each tooth 12*a* of the common electrode 12 correspondingly increases. This causes difficulty in transmitting the heat generated at the heating resistor 14 to the main conductor 12*b* via the teeth 12*a*. As a result, the teeth 12*a* heated by the heating resistor 14 are caused to have a high temperature at portions corresponding to the distance S'. This high-temperature state is shown by a curve D' in a graph of FIG. 14. This graph generally illustrates how the temperature of the teeth 12*a* varies in accordance with a distance from the heating resistor 14.

Due to the influence of the teeth 12*a* in a high-temperature state as described above, the recording paper P transferred by the platen roller R is exposed to the high temperature in moving the distance S'. As is well known, the paper P often generates dust when exposed to a high temperature. When such paper dust adheres to the protective film 16 of the printhead, it hinders the paper P from smoothly sliding over the protective film 16, which may bar smooth paper transfer. Since the generation of paper dust increases in proportion to the printing speed of the printer, the printing speed need be limited to not more than 3 inch/sec in an apparatus using the prior-art printhead.

Another drawback is as follows. As described above, the recording paper P is transferred along the transfer path in press contact with the first projection 16*a* of the protective film 16. At this time, unpleasant noise may be made due to strong rubbing of the recording paper P with the first projection 16*a*. Further, friction between the recording paper P and the first projection 16*a* may cause the recording paper P to thermally adhere to the protective film 16 (generation of sticking), which may prevent the smooth transfer of the paper P.

SUMMARY OF THE INVENTION

The present invention has been conceived under the circumstances described above. It is therefore an object of the present invention to provide a thermal printhead which is capable of smoothly transferring a recording paper. Another object of the present invention is to provide a method of making such a thermal printhead.

A thermal printhead provided in accordance with a first aspect of the present invention comprises an insulating substrate, a common electrode formed on the substrate, a linear heating resistor electrically connected to the common electrode, and a plurality of individual electrodes electrically connected to the heating resistor. The common electrode includes a plurality of comb-teeth and a main conductor connected to the comb-teeth. The heating resistor has a predetermined width. The distance between the main conductor and the heating resistor is smaller than the width of the heating resistor.

Preferably, the distance between the main conductor and the heating resistor may be no less than 0.25 times but no more than 0.75 times the width of the heating resistor.

Preferably, the thermal printhead according to the present invention may further comprise an auxiliary conductor provided on the main conductor.

Preferably, the distance between the auxiliary conductor and the heating resistor may be no less than twice the distance between the main conductor and the heating resistor.

Preferably, the thermal printhead according to the present invention may further comprise a protective coating for covering the heating resistor.

The protective coating may have a flat exposed surface.

Preferably, the thermal printhead according to the present invention may further comprise a glaze layer which supports the heating resistor and has a crescent cross section. The protective coating may include a bulging portion following the glaze layer.

Preferably, the glaze layer and the bulging portion may have respective curved profiles which are cross-sectionally parallel with each other.

Preferably, the protective coating includes a first protective film directly contacting the heating resistor and a second protective film formed on the first protective film.

Preferably, the first protective film may include a thin-wall portion located adjacent to the heating resistor.

Preferably, the first protective film and the second protective film may be formed of a same glass material. Alternatively, the first protective film may be made of glass, whereas the second protective film may be made of sialon.

A method of making a thermal printhead provided in accordance with a second aspect of the present invention comprises a step of preparing an insulating substrate, a step of forming on the substrate a conductor pattern and a heating resistor electrically connected to the conductor pattern, a step of forming a first protective film for covering the heating resistor, a step of removing a bulging portion formed in the first protective film due to the heating resistor and a step of forming a second protective film on the first protective film.

Other features and advantages of the present invention will become clearer from the detailed description given below with reference to the accompanying drawings.

DETAILED DESCRIPTION OF THE PREFERRED EMBODIMENTS

Preferred embodiments of the present invention will be described below in detail with reference to the accompanying drawings.

Figure 1:
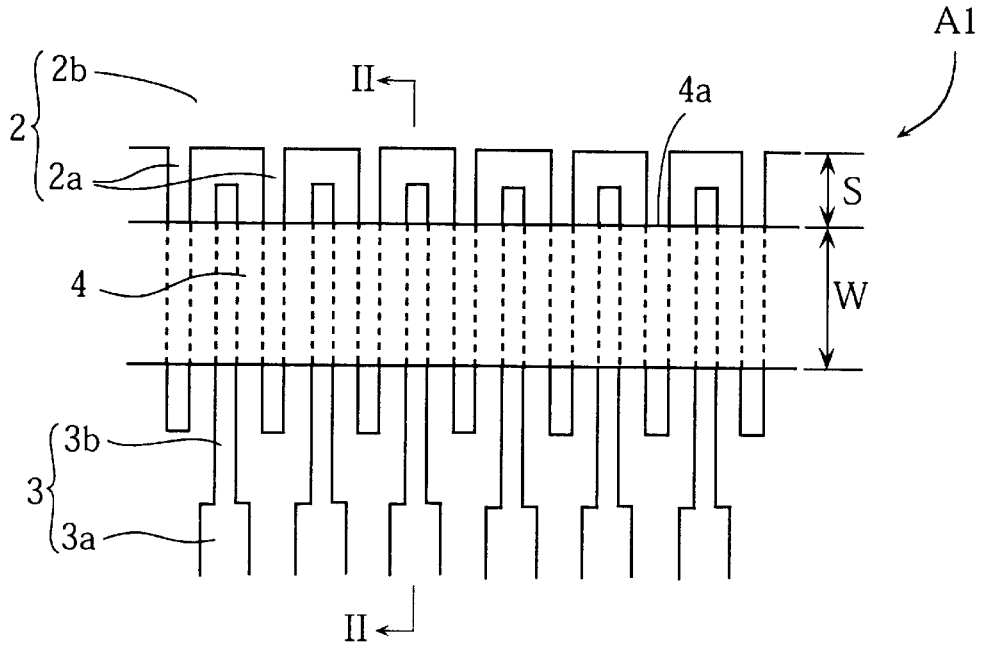
FIG. 1 is a plan view illustrating principal portions of a thermal printhead according to a first embodiment of the present invention.
Figure 2:
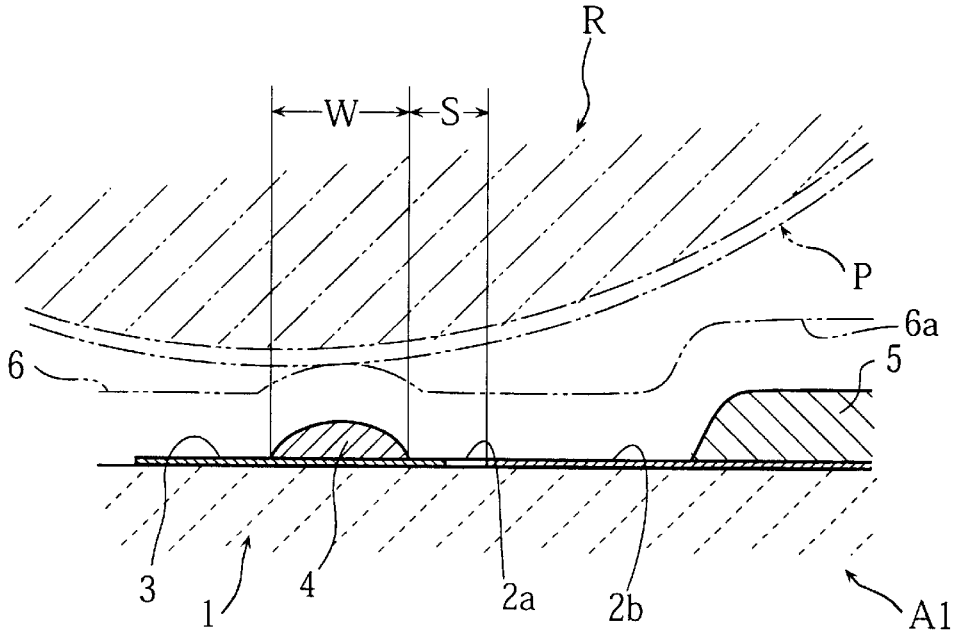
FIG. 2 is a sectional view taken along lines II—II in FIG. 1.

First, reference is made to FIGS. 1 and 2. These figures show principal portions of a thick-film thermal printhead A1 according to a first embodiment of the present invention.

The printhead A1 includes an insulating head substrate 1 formed of a ceramic material. Though not illustrated, the head substrate 1 comprises a flat rectangular plate which is elongated right and left in FIG. 1. The head substrate 1 has an upper surface formed with a common electrode 2 and a plurality of individual electrodes 3. As shown in FIG. 1, the common electrode 2 includes a plurality of comb-teeth 2*a*, and a main conductor 2*b* to which the teeth 2*a* are connected. The main conductor 2*b* extends longitudinally of the substrate 1. Each of the individual electrodes 3 includes a relatively wide first portion 3*a* and a relatively narrow second portion 3*b*. The second portion 3*b* of each individual electrode 3 extends between adjacent comb-teeth 2*a*. The common electrode 2 and the individual electrodes 3 may be made of gold for example and have a thickness of not more than 1 $\mu$m.

The printhead A1 further includes a heating resistor 4 extending longitudinally of the substrate 1. As shown in FIG. 1, the heating resistor 4 extends across the comb-teeth 2*a* and the second portions 3*b* of the individual electrodes 3. The heating resistor 4 may be formed by screen-printing a resistor material. The heating resistor 4 has a maximum thickness of 3–9 $\mu$m for example.

As shown in FIG. 2, the main conductor 2*b* of the common electrode 2 is upwardly formed with an auxiliary conductor 5 formed of silver for example. The auxiliary conductor 5 may be formed by screen-printing to have a thickness of about 10–15 $\mu$m. The auxiliary conductor 5 extends longitudinally of the main conductor 2*b* and has a function of alleviating a voltage drop at the common electrode 2.

The printhead A1 further includes a protective coating 6 made of glass material. The protective coating 6 is formed on the substrate 1 for covering the common electrode 2, the individual electrodes 3, the heating resistor 4 and the auxiliary conductor 5.

Figure 14:
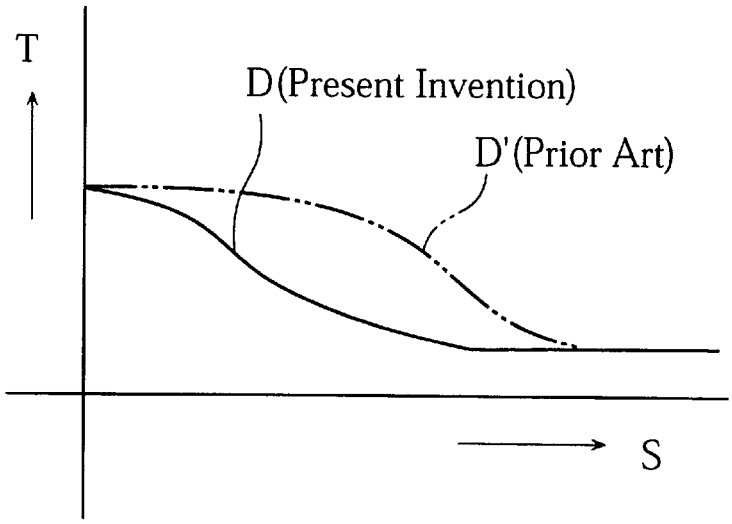
FIG. 14 is a graph showing distribution of temperature of comb-teeth of the thermal printhead of the prior art and the thermal printhead of the present invention.
Figure 15:
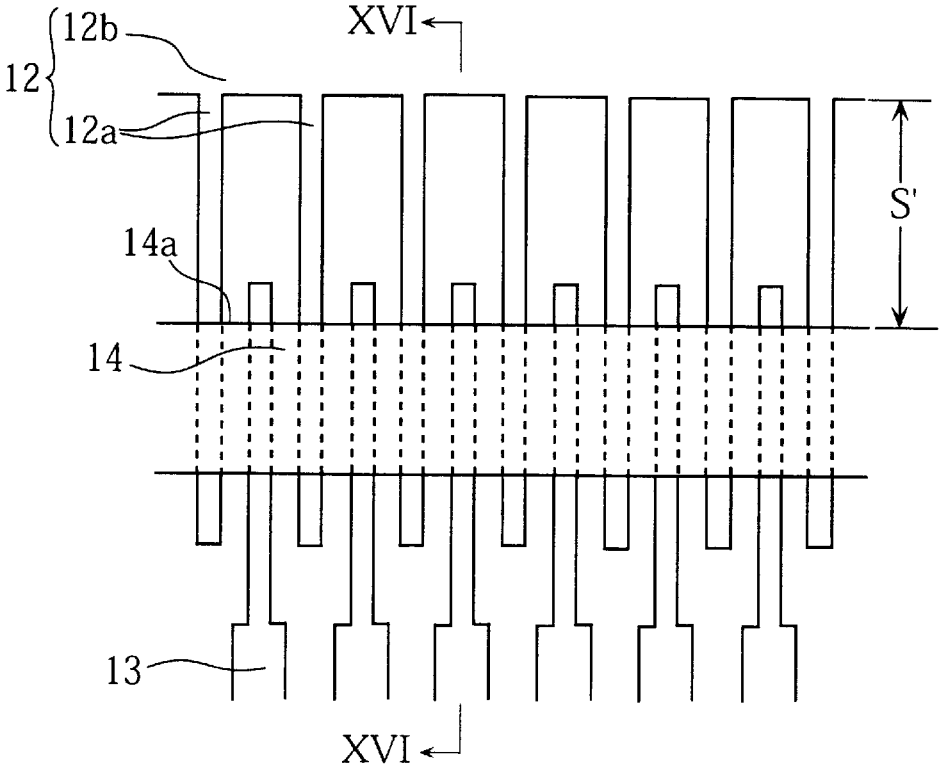
FIG.15 PRIOR ART
FIGS. 15 and 16 illustrate principal portions of the prior-art thermal printhead.

According to a first embodiment of the present invention, a distance S from one edge 4*a* (FIG. 1) of the heating resistor 4 to the main conductor 2*b* of the common electrode 2 is smaller than a conventional value (200–300 $\mu$m). Specifically, when the heating resistor 4 has a width W of 200 $\mu$m, the distance S is 50–150 $\mu$m. In this way, when the distance S is 0.25–0.75 times the width W of the heating resistor 4, it is possible to efficiently transfer the heat generated at the heating resistor 4 to the main conductor 2*b* via each of the comb-teeth 2*a*. Therefore, the temperature of each of the comb-teeth 2*a* drops rapidly (See a curve D in FIG. 14), so that generation of paper dust due to the heat at the comb-teeth 2*a* can be effectively prevented. Therefore, with a printing apparatus using the printhead A1, it is possible to smoothly transfer the paper P and to perform printing at a speed of not lower than 5–6 inch/sec which is higher than the conventional printing speed.

As described above, in the printhead A1, the distance S is made smaller than that of the prior-art printhead, while, similarly to the prior art printhead, the auxiliary conductor 5 is sufficiently spaced from the heating resistor 4. With this structure, it is possible to prevent the paper P from coming into contact with the projection 6*a* (FIG. 2) of the protective coating 6. In the example shown in FIG. 2, the distance between the heating resistor 4 and the auxiliary conductor 5 is made about 4.5 times the distance S.

Figure 4:
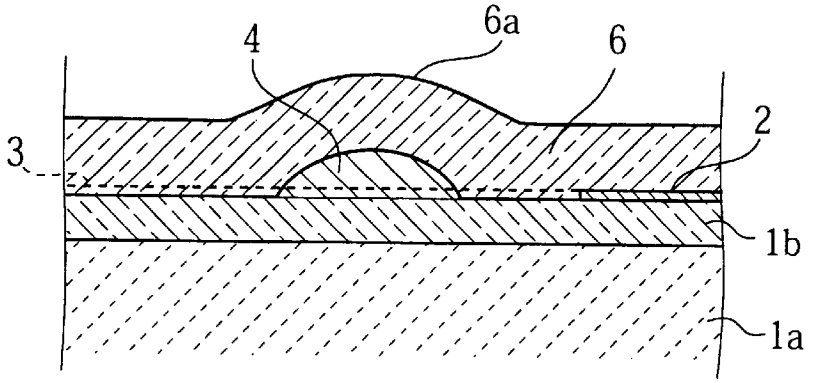
Figure 5:
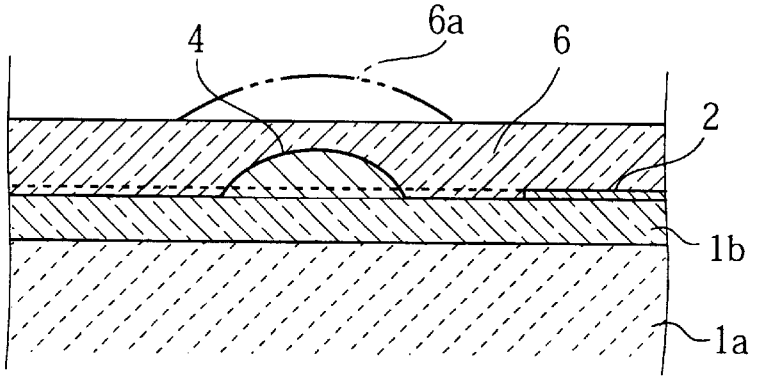
Figure 6:
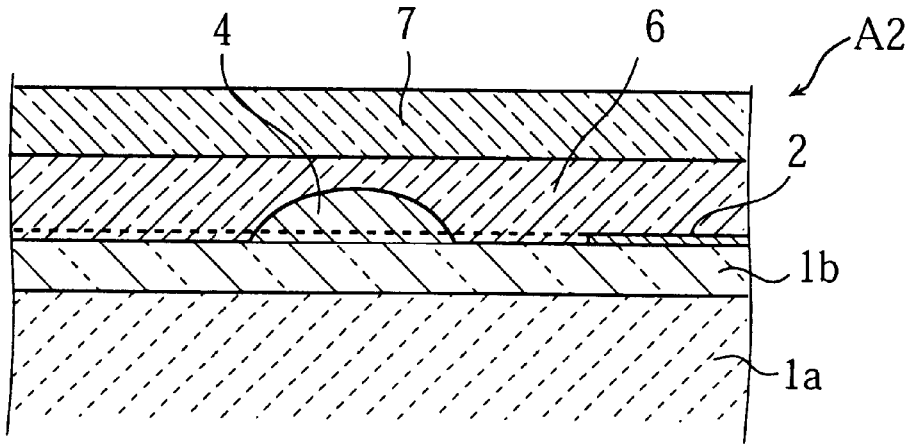

Next, reference is made to FIGS. 3 through 7. These figures illustrate main process steps of a method for making a thick-film thermal printhead according to a second embodiment of the present invention. As shown in FIG. 6, a printhead A2 of the second embodiment differs in some respects from the printhead A1 of the first embodiment. In particular, the printhead A2 is characterized by that a protective coating is not provided with a projection at a location corresponding to a heating resistor.

Figure 3:
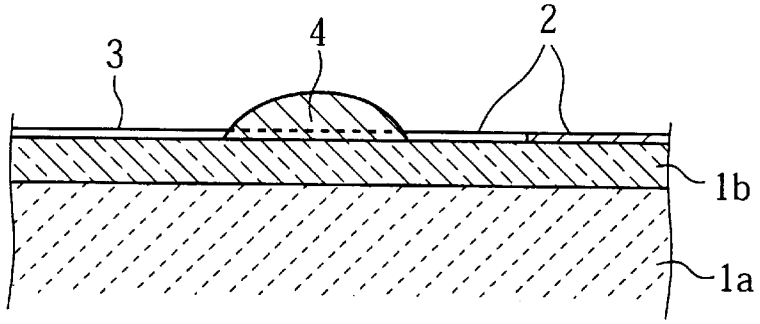
FIGS. 3 through 7 illustrate main process steps of a method for making a thermal printhead according to a second embodiment of the present invention.

The printhead A2 is made as follows. First, as shown in FIG. 3, a glaze layer 1*b* is formed on an upper surface of an insulating head substrate 1*a*. On the glaze layer 1*b*, a common electrode 2 and a plurality of individual electrodes 3 are formed. Though not illustrated in the figure, similarly to the first embodiment, the common electrode 2 comprises a plurality of comb-teeth and an elongate main conductor connecting the comb-teeth. Further, a heating resistor 4 extending across the comb-teeth of the common electrode 2 and the individual electrodes 3 is formed on the glaze layer 1*b*.

Subsequently, as shown in FIG. 4, a first protective film 6 is formed on a surface of the glaze layer 1*b* for covering the common electrode 2, the individual electrodes 3 and the heating resistor 4. The protective film 6 may be formed by screen-printing a glass material on the glaze layer 1*b* followed by baking the material. The protective film 6 may have a thickness of about 6–10 μm, which is larger than the maximum height of the heating resistor 4. Due to the existence of the heating resistor 4, the protective film 6 includes a bulging portion indicated by a reference sign 6*a*.

Subsequently, as shown in FIG. 5, the bulging portion 6*a* is removed by grinding for flattening the entire upper surface of the protective film 6. The protective film 6 after the removal of the bulging portion 6*a* includes a thin portion located adjacent to the heating resistor 4 and a remaining thick portion.

Finally, as shown in FIG. 6, a second protective film 7 is formed on an upper surface of the first protective film 6. The second protective film 7 is equal in thickness (about 6–10 μm) to the first protective film 6. The second protective film 7 may be formed by screen-printing and baking using the same glass material as that of the first protective film 6.

Figure 16:
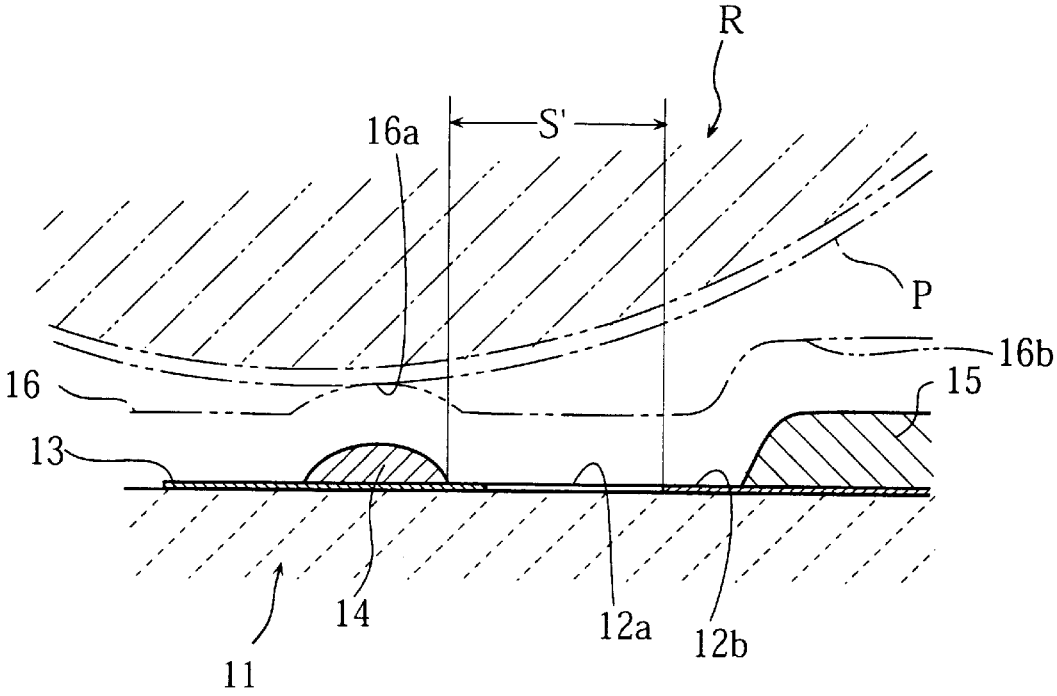
FIG.16 PRIOR ART

In the printhead A2 formed by the above-described method, the second protective film 7 is not formed with a bulging portion even in the proximity of the heating resistor 4. Therefore, unlike the prior art printhead (FIG. 16), the problems such as generation of noise or sticking of a paper can be effectively alleviated or eliminated in the printhead A2.

Figure 7:
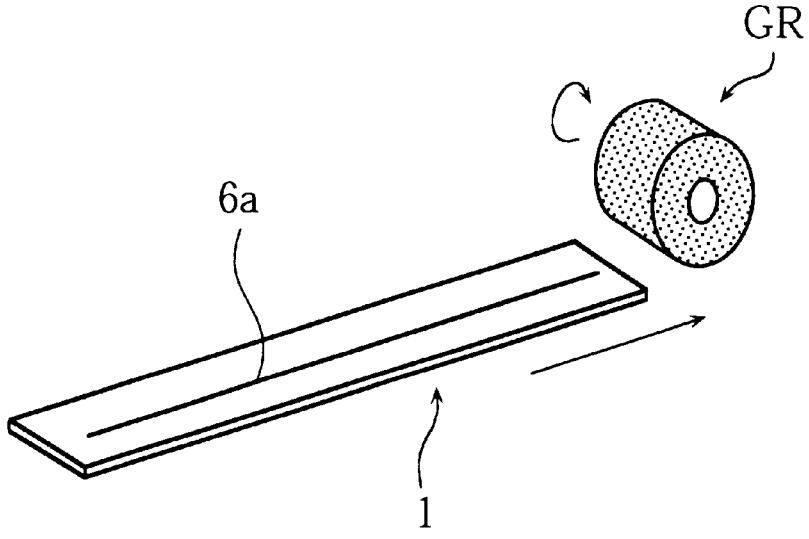
Figure 8:
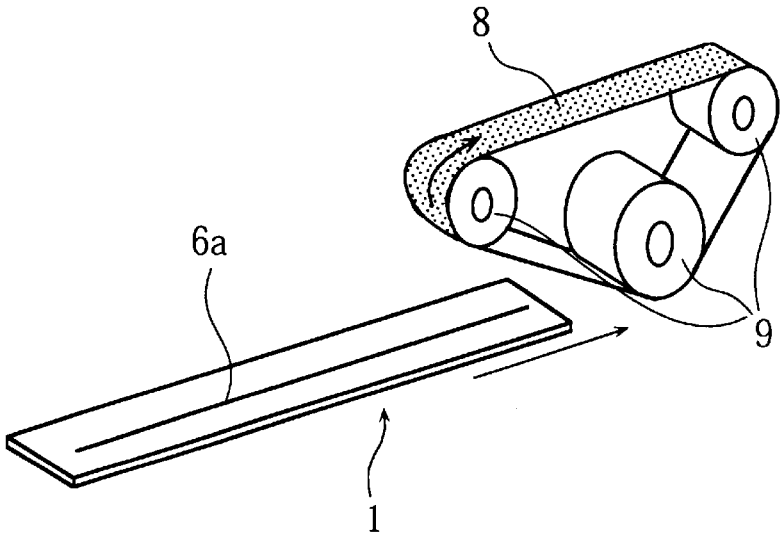
FIG. 8 illustrates an example of grinder which is useful for making a thermal printhead according to the second embodiment.
Figure 9:
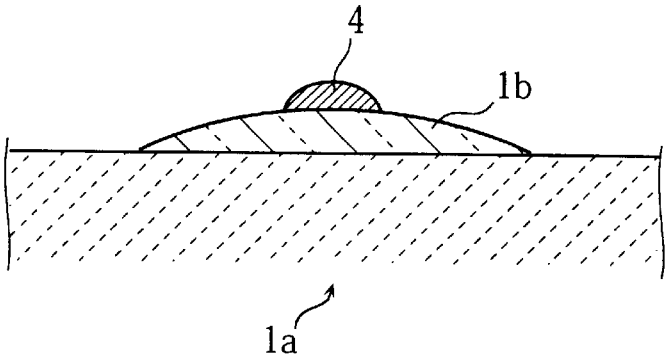
FIGS. 9 through 12 illustrate main process steps of a method for making a thermal printhead according to a third embodiment of the present invention.

According to the present invention, the removal of the bulging portion 6*a* of the protective film 6 (FIG. 5) may be performed using a columnar grindstone GR shown in FIG. 7. Specifically, the rotating grindstone GR is brought into contact with the bulging portion 6*a* and moved longitudinally of the substrate 1. At this time, the substrate may be moved with the grindstone GR kept stationary, or vice versa. Further, instead of the grindstone GR shown in FIG. 7, a grinder shown in FIG. 8 may be used. The grinder includes an endless belt 8 and a plurality of rollers 9. The endless belt 8 has an outer surface to which grinding particles are applied. The removal of the bulging portion 6*a* may be performed by bringing the bulging portion 6*a* into contact with the rotating belt 8.

Moreover, though not illustrated, the removal of the bulging portion 6*a* may be performed by spraying grinding particles. Further, instead of mechanical techniques, the bulging portion 6*a* may be removed by etching with a chemical agent. Further, although the bulging portion 6*a* is completely removed in FIG. 5, the present invention is not limited thereto. For instance, the height of the bulging portion 6*a* may be just reduced to such a degree that the bulging portion does not appear on a surface of the second protective film 7 (See FIG. 6).

Referring now to FIGS. 9 through 12, a method for making a thick-film thermal printhead A3 (FIG. 12) according to a third embodiment of the present invention will be described.

First, a glaze layer 1*b* having a crescent cross section is formed on an upper surface of an insulating substrate 1*a*. Subsequently, a heating resistor 4 is formed on the glaze layer 1*b*. Though not illustrated, a common electrode and individual electrodes for connection to the heating resistor 4 are formed on the substrate 1*a* and the glaze layer 1*b*.

Figure 10:
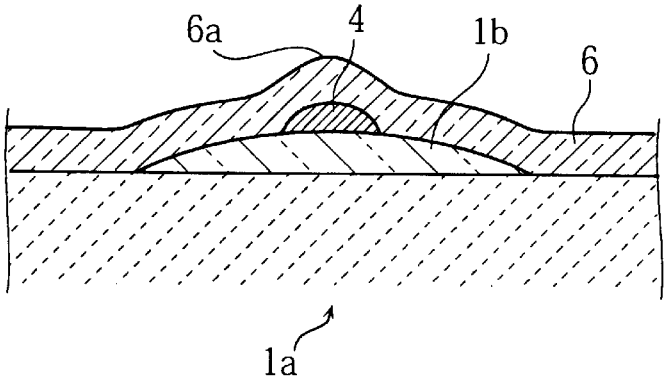

Subsequently, as shown in FIG. 10, a first protective film 6 is formed on the substrate 1*a* for covering the heating resistor 4 and the glaze layer 1*b*. Due to the existence of the heating resistor 4, the protective film 6 includes a bulging portion 6*a*.

Figure 11:
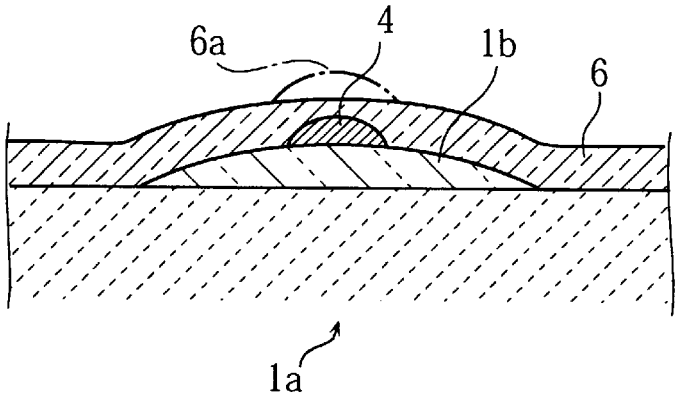

As shown in FIG. 11, the bulging portion 6*a* is then removed by grinding for example.

Figure 12:
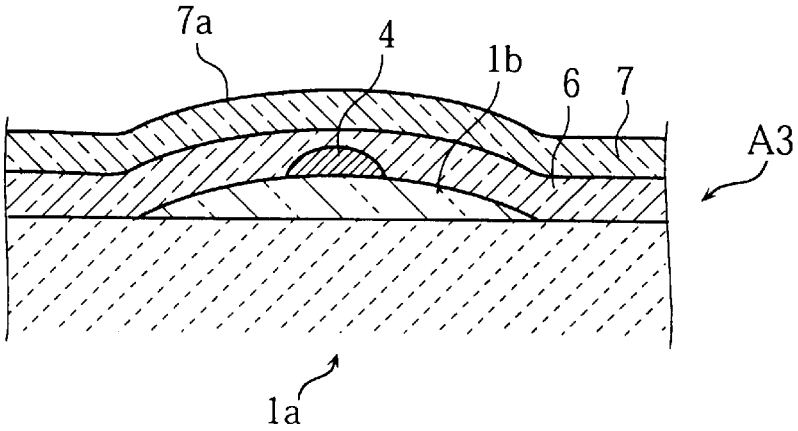

Finally, as shown in FIG. 12, a second protective film 7 is formed on an upper surface of the first protective film 6.

As shown in FIG. 12, in the printhead A3 obtained by the above-described method, the protective film 7 includes the bulging portion 7*a*. However, the bulging portion 7*a*, which is formed due to the existence of the glaze layer 1*b*, has a profile which is much gentler than that of the bulging portion 6*a* which has been removed. In the section shown in FIG. 12, the curved profile of the bulging portion 7*a* extends in parallel with the curved profile of the glaze layer 1*b*. Such a gentle bulging portion does not unduly hinder transfer of a recording paper.

Figure 13:
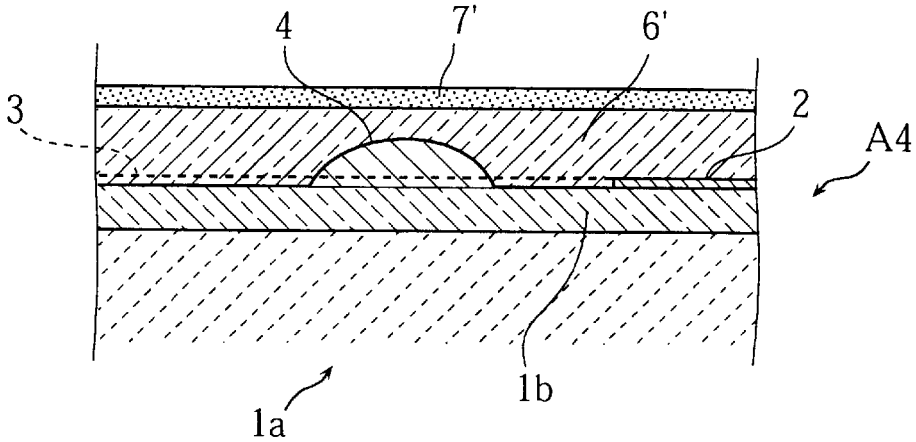
FIG. 13 is a sectional view illustrating a thermal printhead according to a fourth embodiment of the present invention.

FIG. 13 illustrates a thick-film thermal printhead A4 according to a fourth embodiment of the present invention. The printhead A4 has a structure which is basically the same as that of the printhead A2 (FIG. 6) of the second embodiment. Specifically, the printhead A4 includes an insulating substrate 1*a*, a glaze layer 1*b*, a common electrode 2, individual electrodes 3, a heating resistor 4, a first protective film 6' and a second protective film 7'. However, the second protective film 7' of the printhead A4 differs from the second protective film 7 of the printhead A2 in material and thickness. Specifically, the second protective film 7 is made of a glass material, whereas the second protective film 7' of the printhead A4 is made of sialon. Further, the second protective film 7 is equal in thickness to the first protective film 6, whereas the second protective film 7' of the printhead A4 has a thickness which is smaller than that of the first protective film 6'. The protective film 7' having these characteristics may be formed by spattering.

The present invention being thus described, it is apparent that the same may be varied in many ways. Such variations should not be regarded as a departure from the spirit and scope of the present invention, and all such modifications as would be obvious to those skilled in the art are intended to be included within the scope of the following claims.

What is claimed is:

1. A thermal printhead comprising:

an insulating substrate;

a common electrode formed on the substrate, the common electrode including a plurality of comb-teeth and a main conductor connected to the comb-teeth;

a linear heating resistor connected to the comb-teeth and having a predetermined width;

a plurality of individual electrodes connected to the heating resistor;

wherein the main conductor and the heating resistor are spaced form each other by a distance which is smaller than the width of the heating resistor.

2. The thermal printhead according to claim 1, wherein the distance between the main conductor and the heating resistor is no less than 0.25 times but no more than 0.75 times the width of the heating resistor.

3. The thermal printhead according to claim 1, further comprising an auxiliary conductor provided on the main conductor.

4. The thermal printhead according to claim 3, wherein the auxiliary conductor and the heating resistor is spaced from each other by a distance no less than twice the distance between the main conductor and the heating resistor.

5. The thermal printhead according to claim 1, further comprising a protective coating for covering the heating resistor.

6. The thermal printhead according to claim 5, wherein the protective coating has a flat exposed surface.

7. The thermal printhead according to claim 5, further comprising a glaze layer which supports the heating resistor and has a crescent cross section, the protective coating including a bulging portion following the glaze layer.

8. The thermal printhead according to claim 7, wherein the glaze layer and the bulging portion have respective curved profiles which are cross-sectionally parallel with each other.

9. The thermal printhead according to claim 5, wherein the protective coating includes a first protective film directly contacting the heating resistor and a second protective film formed on the first protective film.

10. The thermal printhead according to claim 9, wherein the first protective film includes a thin-wall portion located adjacent to the heating resistor.

11. The thermal printhead according to claim 9, wherein the first protective film and the second protective film are formed of a same glass material.

12. The thermal printhead according to claim 9, wherein the first protective film is made of glass and the second protective film is made of sialon.

13. A method for making a thermal printhead comprising the steps of:

preparing an insulating substrate;

forming on the substrate a conductor pattern and a heating resistor electrically connected to the conductor pattern;

forming a first protective film for covering the heating resistor;

removing a bulging portion formed in the first protective film due to the heating resistor; and forming a second protective film on the first protective film.

* * * * *